US008245674B2

(12) United States Patent
Maehara et al.

(10) Patent No.: US 8,245,674 B2
(45) Date of Patent: Aug. 21, 2012

(54) POWER UNIT FOR VEHICLE

(75) Inventors: Hayato Maehara, Wako (JP); Toshiyuki Sato, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 589 days.

(21) Appl. No.: 12/428,999

(22) Filed: Apr. 23, 2009

(65) Prior Publication Data

US 2009/0277406 A1 Nov. 12, 2009

(30) Foreign Application Priority Data

May 12, 2008 (JP) ..... 2008-124647

(51) Int. Cl.
*F01L 9/04* (2006.01)

(52) U.S. Cl. ..... 123/90.11; 123/90.16; 123/193.3; 123/196 CP

(58) Field of Classification Search ..... 123/90.12, 123/90.15, 90.38, 90.11, 90.16, 193.3, 196 CP
See application file for complete search history.

(56) References Cited

U.S. PATENT DOCUMENTS 5,839,408 A * 11/1998 Oike et al. ..... 123/323
6,886,532 B2 * 5/2005 Nohara et al. ..... 123/401
7,845,323 B2 * 12/2010 Neuboeck ..... 123/90.39

FOREIGN PATENT DOCUMENTS

DE 102005027075 A1 * 1/2007
JP 2003-3811 A 1/2003

* cited by examiner

*Primary Examiner* — Ching Chang
(74) *Attorney, Agent, or Firm* — Westerman, Hattori, Daniels & Adrian, LLP

(57) ABSTRACT

Provided is a power unit for a vehicle including an engine main body of an engine having: a valve system capable of changing operational modes of each engine valve; valve controlling apparatuses for controlling operations of the valve system; and a crankcase housing a transmission, the engine main body being mounted on a vehicle frame. The power unit for a vehicle achieves reduction in size of the engine main body in a direction along the axis of a cylinder, and increases the freedom of arranging parts designed to be placed on an upper end portion of the engine main body. The valve controlling apparatuses are attached to the top surface of the crankcase.

7 Claims, 9 Drawing Sheets

POWER UNIT FOR VEHICLE

TECHNICAL FIELD

The present invention relates to a power unit for a vehicle including an engine main body of an engine having: a valve system capable of changing operational modes of an engine valve; a valve controlling apparatus for controlling operations of the valve system; and a crankcase housing a transmission.

BACKGROUND OF THE INVENTION

A power unit for a vehicle has been known through Japanese Patent Application Publication No. 2003-003811 in which a valve controlling apparatus for changing operational modes of a valve system is provided in a head cover of an engine main body.

SUMMARY OF THE INVENTION

Nevertheless, in the case of such a structure as disclosed in Japanese Patent Application Publication No. 2003-003811 in which the valve controlling apparatus is provided in the head cover, the size of the engine main body is increased in a direction along the axis of the cylinder. Particularly if the axis of an electric motor included in the valve controlling apparatus is set in parallel with the direction along the axis of the cylinder as the power unit for a vehicle disclosed in Japanese Patent Application Publication No. 2003-003811, the size of the engine main body is further increased in the direction along the axis of the cylinder. In a case where a fuel tank is arranged above the engine main body, consequently, the top and bottom positions of the fuel tank are elevated upward. The size of the motorcycle is accordingly increased in the vertical direction. Moreover, in some cases where insertion holes to insert ignition plugs are provided in the head cover, consideration needs to be given to an arrangement with which no valve controlling apparatuses overlap the insertion holes for securing ease of maintenance for the ignition plugs. Thus, the arrangement of valve controlling apparatuses is restricted.

With these situations taken into consideration, the present invention has been made. An object of the present invention is to provide a power unit for a vehicle which achieves reduction in size of an engine main body in the direction along the axis of a cylinder, and which increases the freedom of arranging parts designed to be placed on an upper end portion of the engine main body.

A first aspect of the invention is a power unit for a vehicle including an engine main body of an engine having: a valve system for changing operational modes of an engine valve; a valve controlling apparatus for controlling operations of the valve system; and a crankcase which houses a transmission. The engine main body is mounted on a vehicle frame. The power unit for a vehicle is characterized in that the valve controlling apparatus is attached to the top surface of the crankcase.

A second aspect of the invention is, in addition to the configuration according to the first aspect of the present invention, characterized in that, when viewed from the side, the valve controlling apparatus is arranged in a space surrounded by the top surface of the crankcase, the vehicle frame, and a cylinder block which constitutes a part of the engine main body and is connected to an upper portion of the crankcase.

A third aspect of the invention is, in addition to the configuration according to the first and second aspects of the present invention, characterized in that the valve controlling apparatus is arranged under an air intake system connected to a cylinder head constituting a part of the engine main body.

A fourth aspect of the invention is, in addition to the configuration according to the first, second or third aspects of the present invention, characterized in that a starter motor is attached to the engine main body in a way that the cylinder block is interposed between the starter motor and the valve controlling apparatus, the starter motor being capable of imparting a rotational power to a crankshaft which is rotatably supported by the crankcase, and the cylinder block constituting the part of the engine main body and being connected to the upper portion of the crankcase.

A fifth aspect of the invention is, in addition to the configuration according to the first, second or third aspects of the present invention, characterized in that the valve controlling apparatus is arranged in a location where, when viewed from the side, at least a part of the valve controlling apparatus overlaps a starter motor capable of imparting a rotational power for start to a crankshaft which is rotatably supported by the crankcase.

A sixth aspect of the invention is, in addition to the configuration according to the first to fifth aspects of the first to fifth aspects of the present invention, characterized in that the valve controlling apparatus is attached to the top surface of the crankcase in a way that the longitudinal direction of driving means included in the valve controlling apparatus is along the top surface of the crankcase.

A seventh aspect of the invention is, in addition to the configuration according to the first to sixth aspect of the present invention, characterized in that the valve controlling apparatus is attached to the top surface of the crankcase in a way that the driving means included in the valve controlling apparatus faces the outside of the vehicle frame in a width direction of the vehicle.

Note that intake valves 46 and exhaust valves 47 in examples correspond to the engine valves according to the present invention, and that electromagnetic opening/closing valves 85 in the examples correspond to the driving means according to the present invention.

The first aspect of the invention requires the valve controlling apparatus to be arranged on the top surface of the crankcase which is located above the transmission with a sufficient space. For this reason, the first aspect of the invention makes it possible to arrange the valve controlling apparatus by effectively using the space above the crankcase. Thereby, the first aspect of the invention allows the engine to be compact in a direction along the axis of a cylinder, and is capable of increasing the freedom of arranging parts designed to be placed on an upper end portion of the engine main body.

The second aspect of the invention requires the valve controlling apparatus to be arranged in the space surrounded by the cylinder block, the top surface of the crankcase and the vehicle frame, when viewed from the side. For this reason, the second aspect of the invention makes it easy for the valve controlling apparatus to be accessed from the side of the vehicle, and is accordingly capable of increasing workability for detaching and attaching the valve controlling apparatus, and other working. In addition, the second aspect of the invention allows the cylinder block, crankcase and vehicle frame to effectively prevent a flying stone or the like from hitting the valve controlling apparatus.

The third aspect of the invention requires the valve controlling apparatus to be arranged under the air intake system. For this reason, the third aspect of the invention makes it possible for the valve controlling apparatus to be arranged with a better space efficiency by using the space formed between the air intake system and the top surface of the crankcase.

The fourth aspect of the invention requires the starter motor to be arranged on the opposite side of the cylinder block from the valve controlling apparatuses. For this reason, the fourth aspect of the invention secures a wider space above the crankcase, and thereby increases the freedom of arranging the valve controlling apparatus.

The fifth aspect of the invention requires at least a part of the valve controlling apparatus to overlap the starter motor when viewed from the side. For this reason, the fifth aspect of the invention makes it possible to arrange the valve controlling apparatus while effectively using a dead space formed in a vicinity of the starter motor.

The sixth aspect of the invention requires the longitudinal direction of the driving means included in the valve controlling apparatus to be along the top surface of the crankcase. For this reason, the sixth aspect of the invention makes it possible to check the driving means protruding from the top surface of the crankcase, and thus allows both the power unit and the vehicle to be compact in the vertical direction by arranging parts and the like, which are designed to be placed above the valve controlling apparatus, closer to the top surface of the crankcase.

In addition, the seventh aspect of the invention requires the driving means included in the valve controlling apparatus to face the outside of the vehicle frame in the width direction of the vehicle. For this reason, the seventh aspect of the invention makes it easy for the driving means to be accessed, and accordingly to attach and detach the driving means.

BRIEF DESCRIPTION OF THE DRAWINGS

The advantages of the invention will become apparent in the following description taken in conjunction with the drawings, wherein.

DETAILED DESCRIPTION OF THE INVENTION

Descriptions will be provided hereinbelow for an embodiment of the present invention on the basis of examples of the present invention shown in the attached drawings. Further, "left", "right", "up", "down", etc. indicate directions as viewed by a driver of a vehicle.

Figure 1:
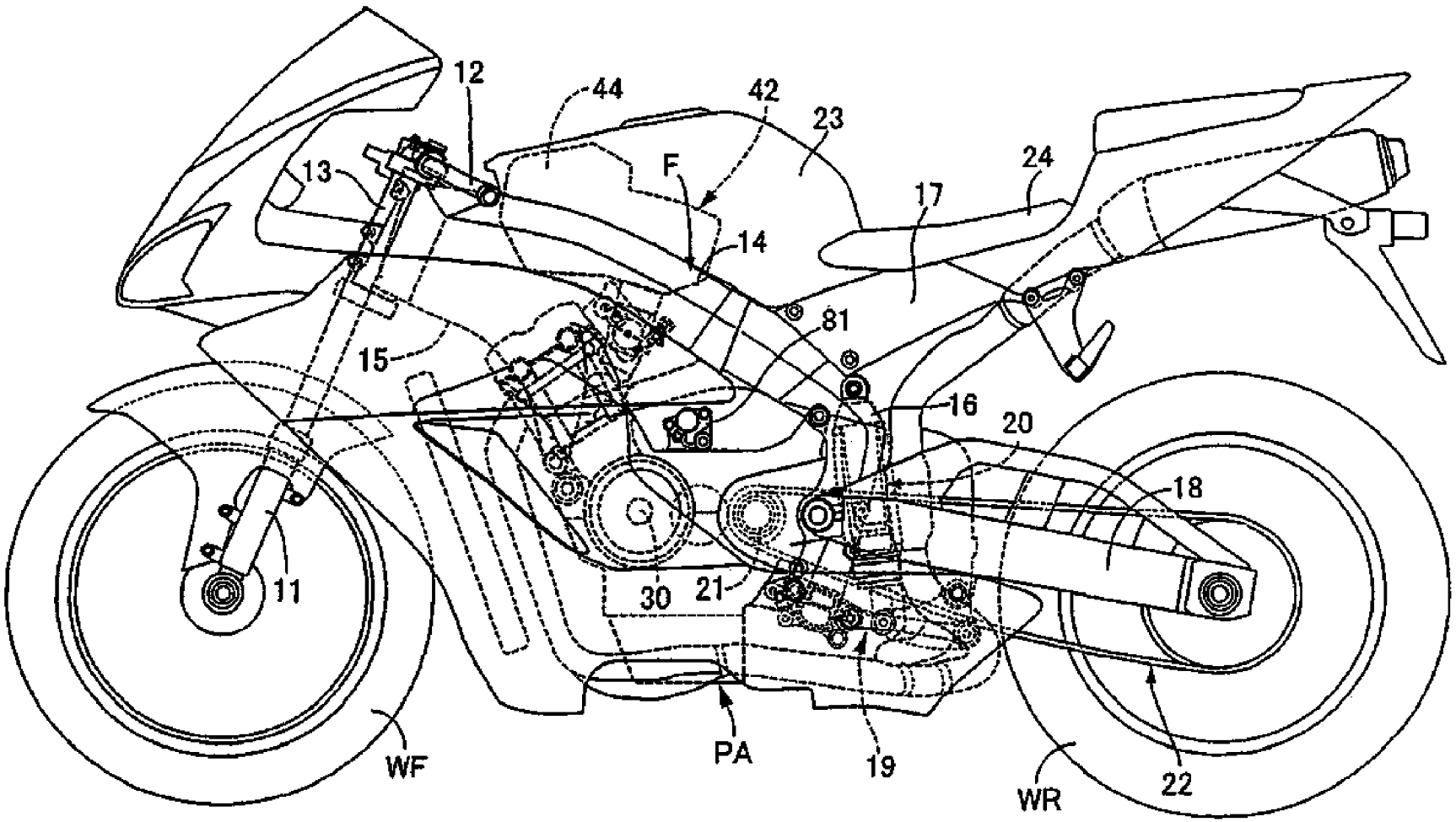
FIG. 1 is a left side view of a motorcycle according to a first embodiment.
Figure 2:
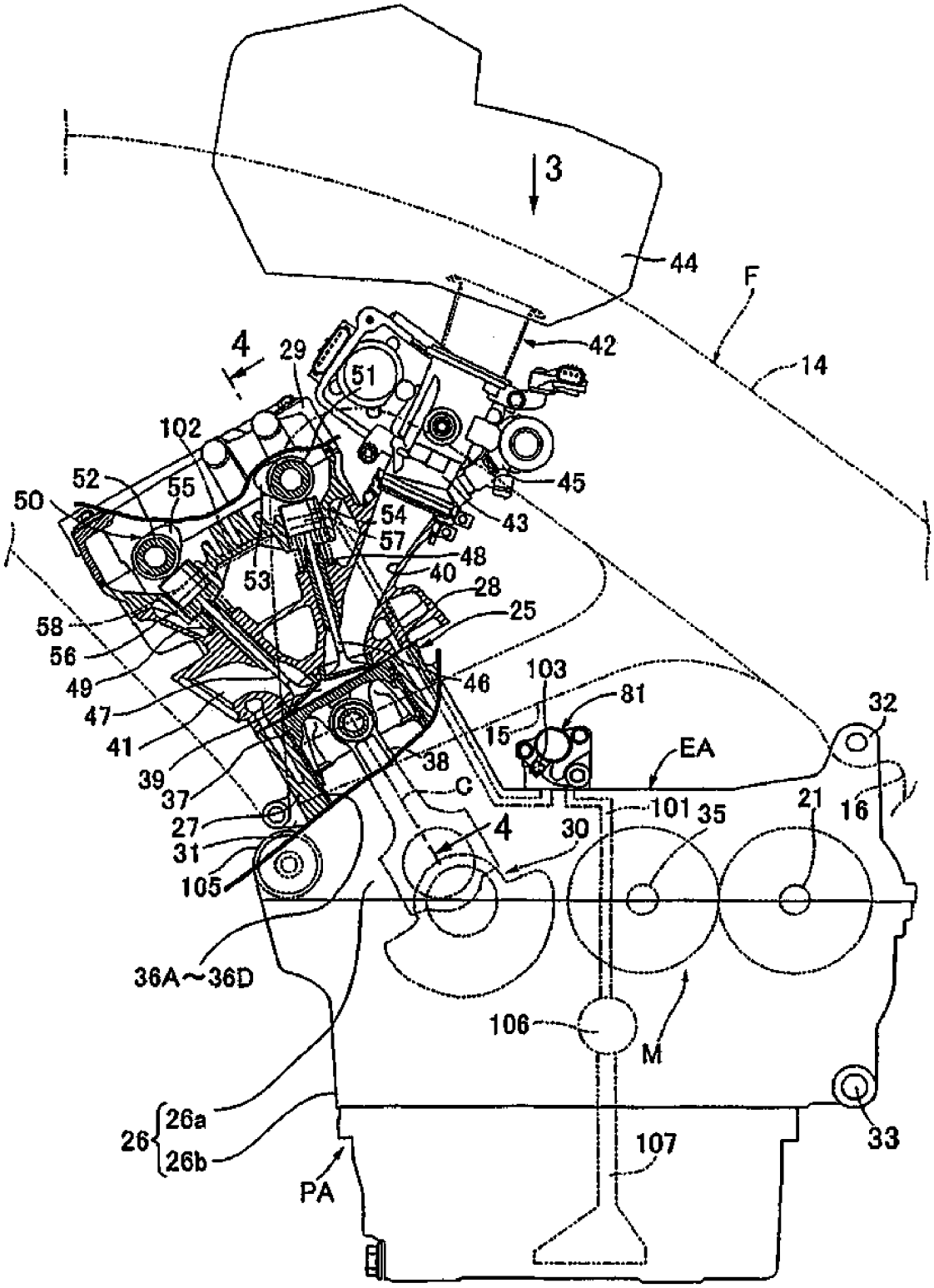
FIG. 2 is a partially cut-away side view of a power unit of the first embodiment which is viewed from the left.
Figure 3:
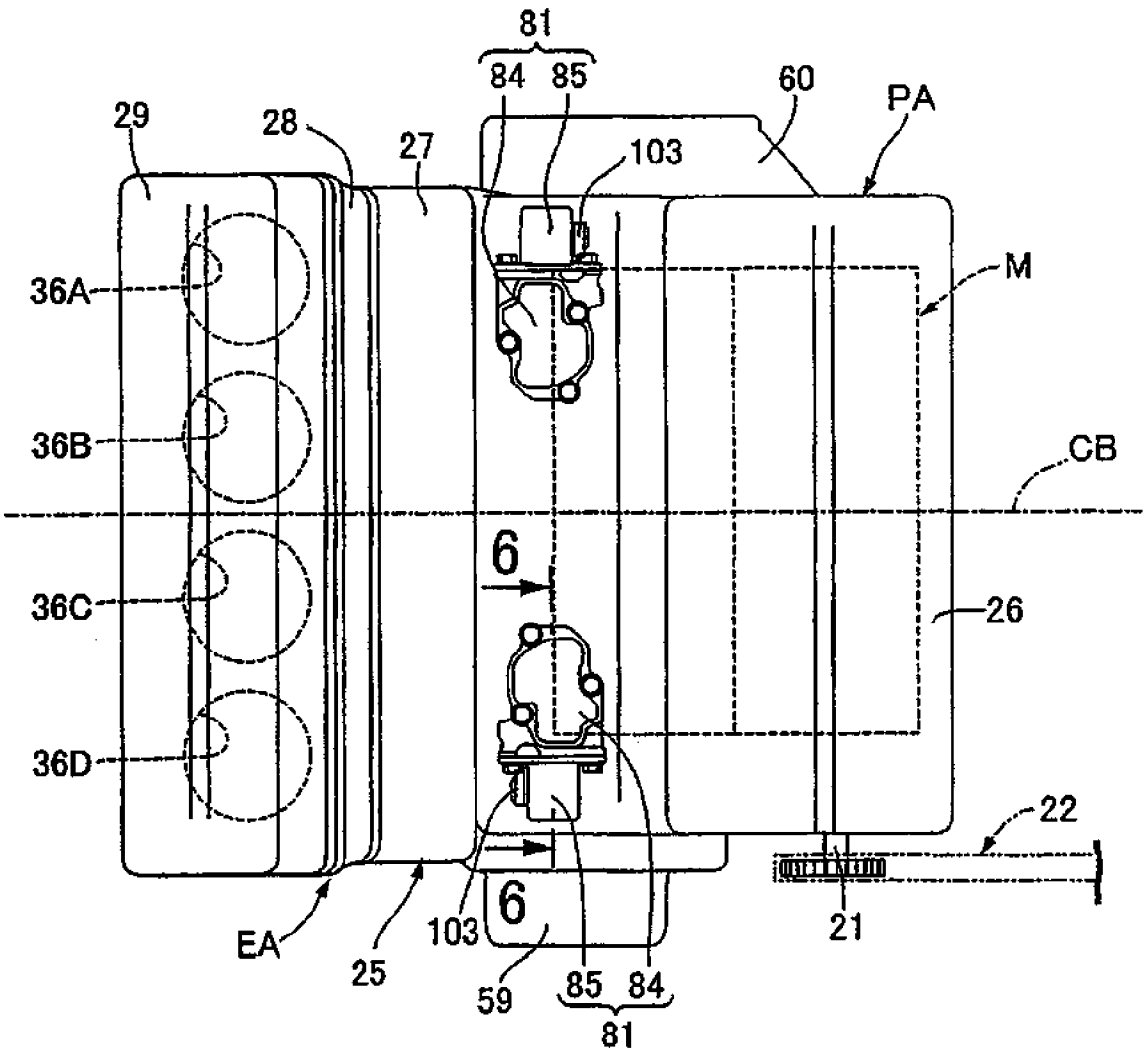
FIG. 3 is a plan view of the power unit of the first embodiment which is viewed in a direction indicated by an arrow 3 of FIG. 2.
Figure 4:
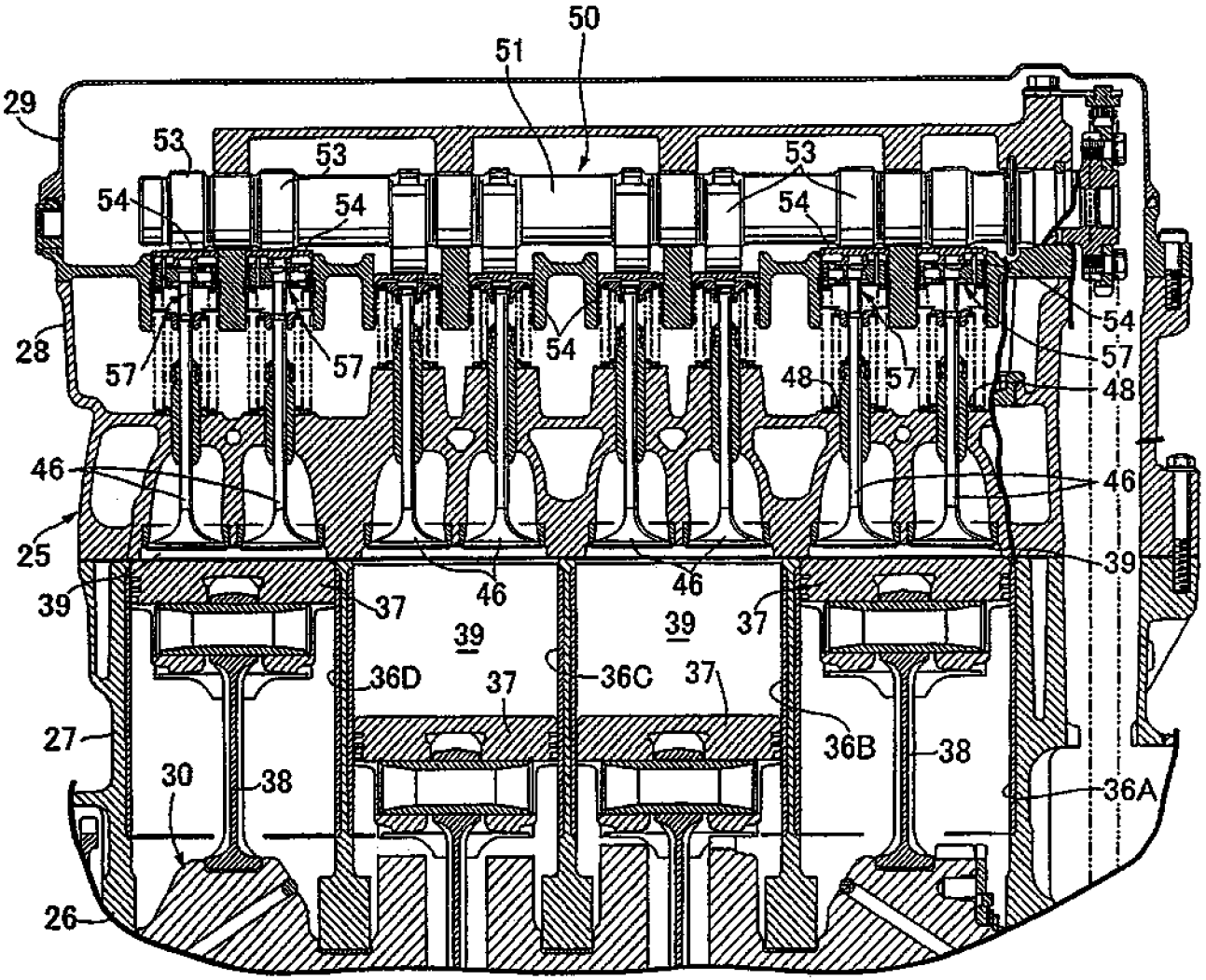
FIG. 4 is a cross-sectional view of the power unit of the first embodiment taken along the 4-4 line of FIG. 2.
Figure 5:
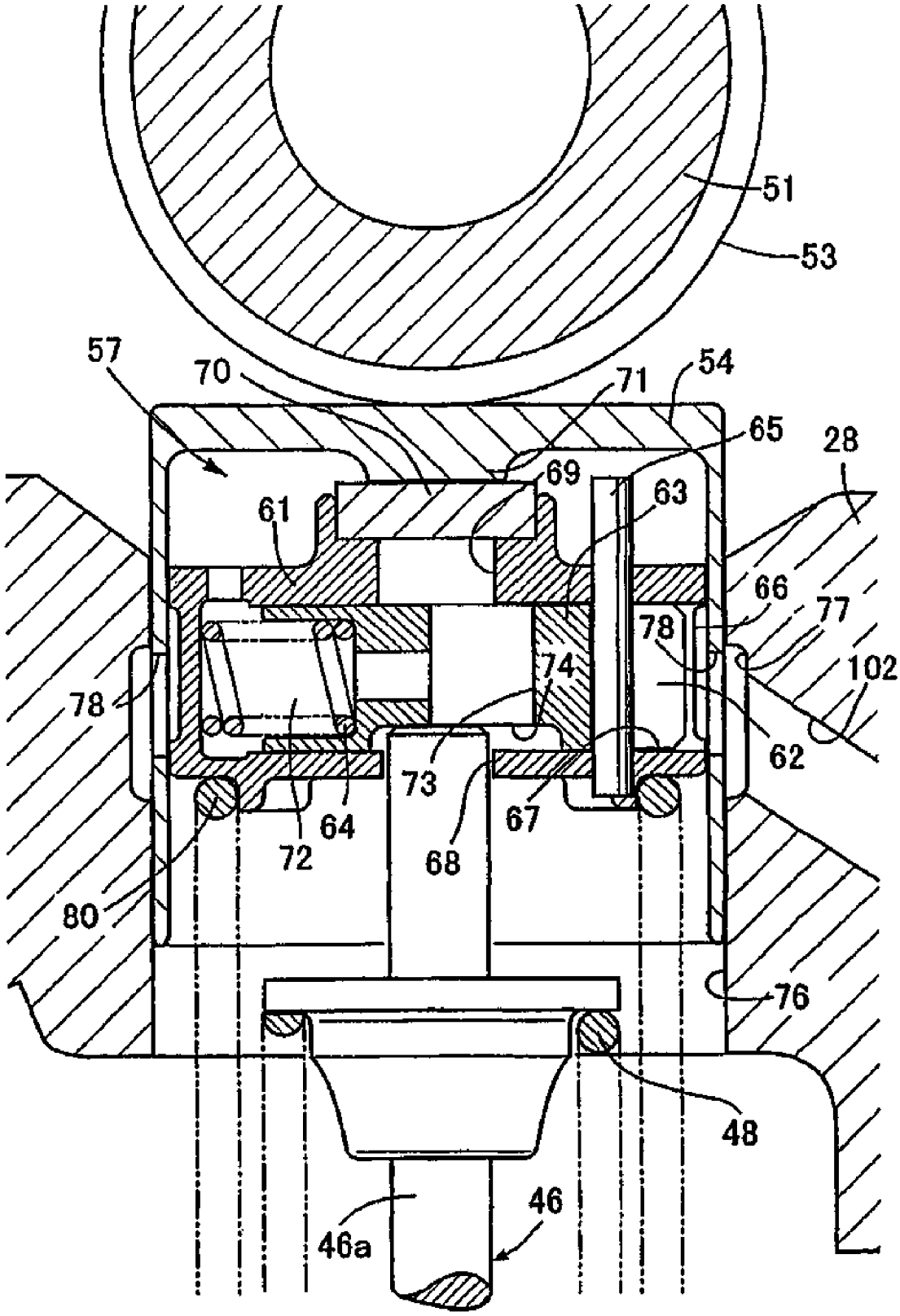
FIG. 5 is a vertical cross-sectional view of an intake-valve-operation-mode changing mechanism of the first embodiment.
Figure 6:
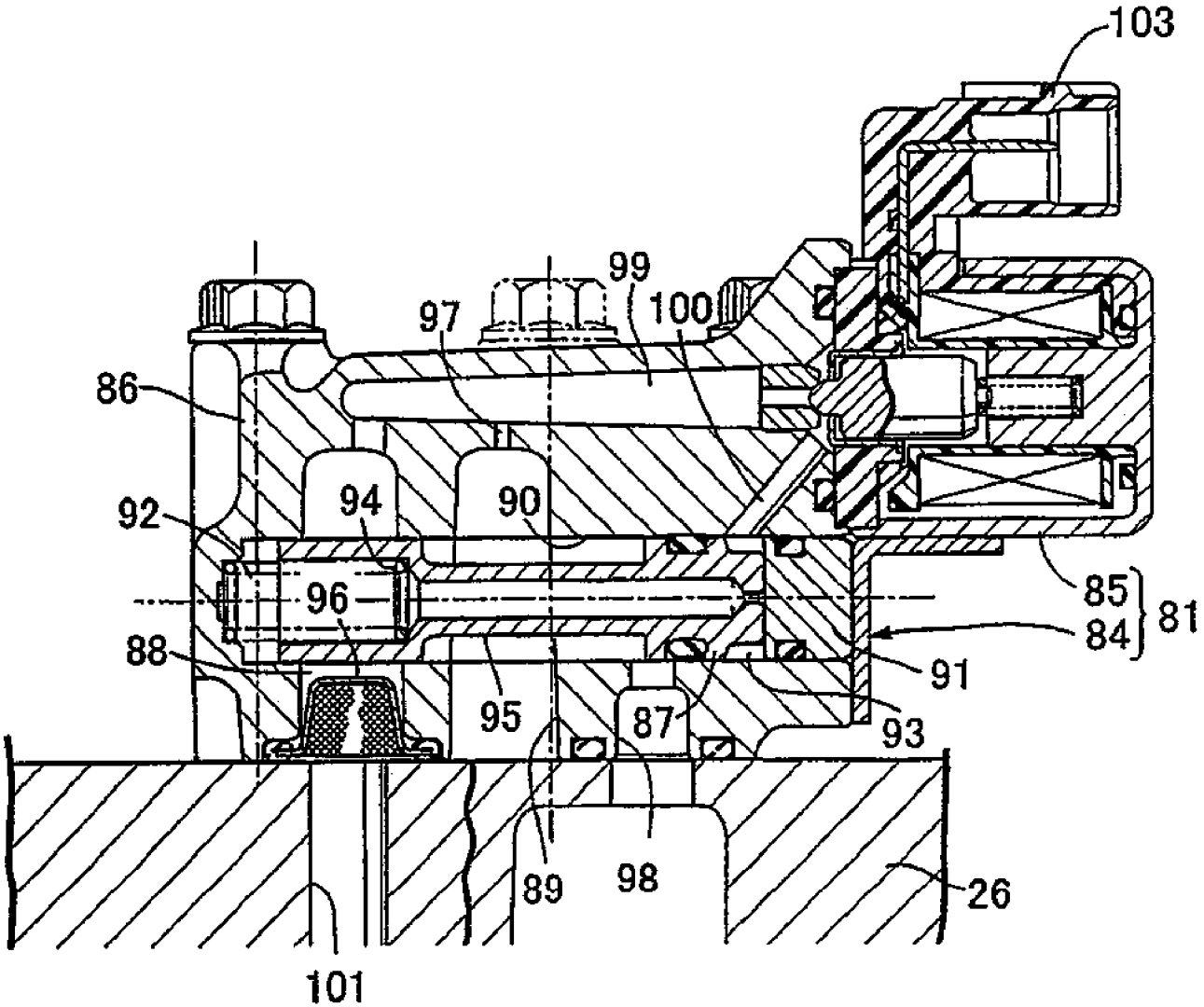
FIG. 6 is a cross-sectional view of the power unit of the first embodiment taken along the 6-6 line of FIG. 3

FIGS. 1 to 6 show a first example of the present invention. FIG. 1 is a left side view of a motorcycle. FIG. 2 is a partially cut-away side view of a power unit which is viewed from the left. FIG. 3 is a plan view of the power unit which is viewed in a direction indicated by an arrow 3 of FIG. 2. FIG. 4 is a cross-sectional view of the power unit taken along the 4-4 line of FIG. 2. FIG. 5 is a vertical cross-sectional view of an intake-valve-operation-mode changing mechanism. FIG. 6 is a cross-sectional view of the power unit taken along the 6-6 line of FIG. 3.

First of all, in FIG. 1, a vehicle frame F of a motorcycle as a vehicle includes: a head pipe 13 for movably supporting a front fork 11 and a steering handle 12 in such a way as to be steerable, the front fork 11 being for pivotally supporting a front wheel WF; paired left and right main frames 14 which extend rearward and downward from the head pipe 13; paired left and right engine hangers 15 which communicate with the head pipe 13 and the front portions of the respective two main frames 14, and which extend downward from the respective two main frames 14; paired left and right pivot plates 16 which extend downward from the rear portions of the respective main frames 14; and paired left and right seat rails 17 which extend rearward and upward, and which are connected to the rear portions of the respective two main frames 14.

Swing arms 18 for pivotally supporting a rear wheel WR are movably supported by the respective pivot plates 16 in such a way as to be swingable upward and downward. A link mechanism 19 is provided among the lower portions of the swing arms 18 and the pivot plates 16. A rear cushion unit 20 is provided among a member constituting a part of the link mechanism 19 and the upper portions of the respective pivot plates 16.

A power unit PA is mounted on the vehicle frame F between the front wheel WF and the rear wheel WR. An output shaft 21 of the power unit PA is linked and connected to the rear wheel WR with a chain transmission mechanism 22. A fuel tank 23 is mounted on the main frames 14 above the power unit PA. A riding seat 24 placed rearward of the fuel tank 23 is supported by the seat rails 17.

In FIGS. 2 and 3, the power unit PA includes: an in-line multi-cylinder engine EA, for example, with four cylinders; and a transmission M for changing the speed of an output from the engine EA stepwise. An engine main body 25 of the engine EA includes: a crankcase 26 for rotatably supporting a crankshaft 30 that has its axis in parallel with the width direction of the vehicle frame F; a cylinder block 27 connected to a front upper portion of the crankcase 26; a cylinder head 28 connected to the cylinder block 27; and a head cover 29 connected to the cylinder head 28.

The crankcase 26 is constructed by connecting an upper crankcase half 26*a* and a lower crankcase half 26*b* together. The cylinder block 27 is integrally formed with the upper crankcase half 26*a*. A generator cover 59 for covering a generator (not illustrated) connected to the crankshaft 30 is attached to the left side surface of the crankcase 26. A clutch cover 60 for covering a clutch (not illustrated) placed between the crankshaft 30 and the transmission M is attached to the right side surface of the crankcase 26.

Brackets 31 attached to the lower portions of the respective engine hungers 15 are provided to the front lower portion of the cylinder block 27. Brackets 32 attached to the upper portions of the respective pivot plates 16 are provided to the rear upper portion of the upper crankcase half 26*a* of the crankcase 26. Brackets 33 attached to the lower portions of the respective pivot plates 16 are provided to the rear lower portion of the lower case half 26*b* of the crankcase 26.

The transmission M is constructed by providing a gear train, which is capable of selectively establishing one out of multiple shifts, between an input shaft 35 and the output shaft 21. A rotational power is transmitted to the input shaft 35 from the crankshaft 30. The transmission M is housed in the crankcase 26 in a way that the transmission M is located rearward of the crankshaft 30 while the axes of the input shaft 35 and the output shaft 21 are in parallel with the axis of the crankshaft 30. In other words, the crankcase 26 has a structure in which the crankcase part for rotatably supporting the crankshaft 30 and the transmission case part for housing the transmission M are integrated into a single unit.

In FIG. 4, the cylinder block 27 includes four cylinder bores 36A, 36B, 36C, 36D which are arranged in parallel with a direction along the axis of the crankshaft 30. The cylinder axes C of the respective cylinder bores 36A to 36D tilt in such a way as to ascend frontward. Pistons 37 are slidably fitted into the respective cylinder bores 36A to 36D. The pistons 37 are connected to the crankshaft 30 with connection rods 38, respectively.

Between the cylinder block 27 and the cylinder head 28, combustion chambers 39 are formed in the respective cylinders. Top portions of the respective pistons 37 slidably fitted into the cylinder bores 36A to 36D face the combustion chambers 39, respectively. In addition, in the cylinder head 28, intake ports 40 and exhaust ports 41 which are capable of communicating with the combustion chambers 39 are provided in the cylinders, respectively. The intake ports 40 are open to the rear side surface of the cylinder head 28, whereas the exhaust ports 41 are open to the front side surface of the cylinder head 28.

An air intake system 42 is connected to the rear side surface of the cylinder head 28. This air intake system 42 includes: throttle bodies 43 communicating with the respective intake ports 40; and an air cleaner 44 which is arranged above the throttle bodies 43, and to which the throttle bodies 43 are commonly connected. Fuel injection valves 45 for injecting fuel into the intake ports 40 are annexed to the throttle bodies 43, respectively. Furthermore, as shown in FIG. 1, the air cleaner 44 is arranged in such a way as to be covered with the fuel tank 23.

In the cylinder head 28, intake valves 46 and exhaust valves 47 are placed in pairs in the cylinders in such a way as to be capable of opening and closing in the cylinders, respectively. The intake valves 46 are biased in valve closing directions by valve springs 48, respectively. The exhaust valves 47 are biased in valve closing directions by valve springs 49, respectively.

A valve system 50 for opening and closing the intake valves 46 and the exhaust valves 47 is housed between the cylinder head 28 and the head cover 29. The valve system 50 includes: an intake cam shaft 51 and an exhaust cam shaft 52 to which a rotational power is transmitted from the crankshaft 30 at a reduction gear ratio of 1/2 through a timing transmission system, which is not illustrated; intake valve lifters 54 which are set between the intake valves 46 and intake valve cams 53 provided to the intake cam shaft 51, and which are slidably fitted into the cylinder head 28; and exhaust valve lifters 56 which are set between the exhaust valves 47 and exhaust valve cams 55 provided to the exhaust cam shaft 52, and which are slidably fitted into the cylinder head 28.

Out of the four cylinders arranged in line, the cylinders located in the two ends in the direction in which the cylinders are arranged are those each capable of being put into a cylinder stop condition, whereas the two cylinders in the middle in the direction in which the cylinders are arranged are those which are always put in operation during the operation of the engine. Built-in intake-valve-operation-mode changing mechanisms 57 for putting the intake valves 46 into the cylinder stop condition by closing and stopping the intake valves 46 are included in the intake valve lifters 54 located in portions of the valve system 50 which correspond to the two end-side cylinders in the direction which the cylinders are arranged, respectively. Built-in exhaust-valve-operation-mode changing mechanisms 58 for putting the exhaust valves 47 into the cylinder stop condition by closing and stopping the exhaust valves 47 are included in the exhaust valve lifters 56 located in the portions of the valve system 50 which correspond to the two end-side cylinders in the direction which the cylinders are arranged, respectively.

In FIG. 5, each intake-valve-operation-mode changing mechanism 57 includes: a pin holder 61 slidably fitted into its corresponding intake valve lifter 54; a slide pin 63 which forms a hydraulic chamber 62 between the slide pin 63 and the inner surface of its corresponding intake valve lifter 54, and which is slidably fitted into the pin holder 61; a return spring 64 which exerts a spring force for biasing the slide pin 63 in such a direction that the volume of the hydraulic chamber 62 decreases, and which is provided between the slide pin 63 and the pin holder 61; a stopper pin 65 which engages with the slide pin 63 and is inserted into the pin holder 61 in order to check the slide pin 63 from revolving about the axis of the slide pin 63.

A circular groove 66 is provided in the outer circumference of the pin holder 61. The pin holder 61 is provided with a closed-end slide hole 67 which has its axis orthogonal to the axis of the intake valve lifter 54. One end of the slide hole 67 is open to the circular groove 66, and the other end of the slide hole 67 is closed. An insertion hole 68 and an extension hole 69 are coaxially provided to the pin holder 61 in a way that an extremity portion of a stem 46*a* of the corresponding intake valve 46 is capable of being accommodated in the insertion hole 68 and the extension hole 69. The insertion hole 68 is that in which the extremity portion of the stem 46*a* of the intake valve 46 biased by the corresponding valve spring 48 in the direction in which the intake valve 46 is closed is inserted. The slide hole 67 is interposed between the extension hole 69 and the insertion hole 68. A disc-shaped shim 70 is fitted in the pin holder 61. The shim 70 closes the end portion of the extension hole 69 at the closed-end side of the valve lifter 54. A protruding part 71 abutting on this shim 70 is integrally provided to the center portion of the internal surface of the closed end of the intake valve lifter 54.

The slide pin 63 is slidably fitted into the slide hole 67 in the pin holder 61. The hydraulic chamber 62 communicating with the circular groove 66 is formed between an end of this slide pin 63 and the inner surface of the intake valve lifter 54. The return spring 64 is housed in a spring chamber 72 formed between the opposite end of the slide pin 63 and the closed end of the slide hole 67.

An accommodation hole 73 capable of coaxially communicating with the insertion hole 68 and the extension hole 69 is provided in the middle portion of the slide pin 63 in the axial direction in a way that the accommodation hole 73 can accommodate the extremity portion of the stem 46*a*. An end portion of the accommodation hole 73 at the insertion hole 68 side is open to a flat abutment surface 74 formed in the lower external surface of the slide pin 63 in such a way as to be opposed to the insertion hole 68. The abutment surface 74 is formed relatively long in the axial direction of the slide pin 63. The accommodation hole 73 is open to a part of the abutment surface 74 at the hydraulic chamber 62 side.

The slide pin 63 thus configured slides in its axial direction in a way that a hydraulic force acting on an end side of the slide pin 63 due to the hydraulic pressure from the hydraulic chamber 62 balances with a spring force acting on the opposite end side of the slide pin 63 due to the return spring 64. When the hydraulic pressure in the hydraulic chamber 62 is lower, the accommodation hole 73 is shifted from the axes of the insertion hole 68 and the extension hole 69, and thereby the slide pin 63 is moved rightward in FIG. 5 until the slide pin 63 abuts onto the stopper pin 65 in order that the extremity of the stem 46*a* can abut onto the abutment surface 74. Under an operational condition where the hydraulic pressure of the hydraulic chamber 62 becomes higher, the slide pin 63 is moved leftward in FIG. 5 in order that the extremity portion of the stem 46*a* inserted in the insertion hole 68 can be accommodated in the accommodation hole 73 and the extension hole 69.

When the slide pin 63 moves and thus settles in a position which cause the insertion hole 73 to coaxially communicate with the insertion hole 68 and the extension hole 69, the pin holder 61 and the slide pin 63 moves together with the intake valve lifter 54 toward the intake valve 46 in response to the slide of the intake valve lifter 54 due to a push force acting on the intake valve lifter 54 from the intake valve cam 53. At this time, it is only that the extremity portion of the stem 46*a* is accommodated in the accommodation hole 73 and the extension hole 69, but it is never that a push force acts on the intake valve 46 from the intake valve lifter 54 and the pin holder 61 in a direction in which the intake valve 46 is opened. Consequently, the intake valve 46 remains stopped. On the other hand, when the slide pin 63 moves and settles in a position which causes the extremity portion of the stem 46*a* to abut onto the abutment surface 74, a push force acts on the intake valve 46 in the direction in which the intake valve 46 is opened in response to the movement of the pin holder 61 and the slide pin 63 toward the intake valve 46 depending on the slide of the intake valve lifter 54 due to a push force acting on the intake valve lifter 54 from the intake cam 53. Consequently, the intake valve 46 is opened and closed depending on the rotation of the intake cam 53.

The cylinder head 28 is provided with supporting holes 76 into which the intake valve lifters 54 are fitted in order that the intake valve lifters 54 can be slidably supported by the supporting holes 76, respectively. Circular concave parts 77 are provided in the inner surfaces of these supporting holes 76 in a way that the circular concave parts 77 surround the intake valve lifters 54, respectively. Each of the intake valve lifters 54 is provided with multiple communication holes 78. The communication holes 78 are those through which the circular concave parts 77 are respectively caused to communicate with the circular grooves 66 regardless of the slide of the intake valve lifters 54 in the supporting holes 76. In addition, springs 80 for biasing the intake valve lifters 54 in a direction in which the intake valve lifters 54 are caused to abut onto the intake cams 53 are provided between the intake valve lifters 54 and the cylinder head 28.

The built-in exhaust-valve-operation-mode changing mechanisms 58 included in the respective exhaust valve lifters 56 are configured in the same manner as the intake-valve-operation-mode changing mechanisms 57 are configured. Each exhaust-valve-operation-mode changing mechanism 58 is capable of switching the valve operational modes of the corresponding one of the exhaust valves 47 between a valve closing and stopping mode for a case where a highly-pressurized hydraulic pressure acts on the exhaust-valve-operation-mode changing mechanism 58 and a valve opening and closing mode for a case where the hydraulic pressure acting on the exhaust-valve-operation-mode changing mechanism 58 becomes lower.

In sum, the valve system 50 is capable of switching the valve operational modes of each of the intake valves 46 annexed to the parts corresponding to the cylinders which are located in the two end sides in the cylinder arrangement direction out of the four in-line cylinders between the valve opening and closing mode and the valve closing and stopping/cylinder stopping mode through the operational control carried out by the intake-valve-operation-mode changing mechanism 57. The valve system 50 is also capable of switching the valve operational modes of each of the exhaust valves 47 annexed to the parts corresponding to the cylinders which are located in the two end sides in the cylinder arrangement direction out of the four in-line cylinders between the valve opening and closing mode and the valve closing and stopping/cylinder stopping mode through the operational control carried out by the exhaust-valve-operation-mode changing mechanisms 58.

The operations of the intake-valve-operation-mode changing mechanism 57 and the exhaust-valve-operation-mode changing mechanism 58 corresponding to one of the two cylinders which are located on the respective two ends in the cylinder arrangement direction are designed to be controlled by one of valve controlling apparatuses 81, 81, whereas the operations of the intake-valve-operation-mode changing mechanism 57 and the exhaust-valve-operation-mode changing mechanism 58 corresponding to the other of the two cylinders which are located on the respective two ends in the cylinder arrangement direction are designed to be controlled by the other of the valve controlling apparatuses 81, 81. As shown in FIGS. 2 and 3, those valve controlling apparatuses 81, 81 are attached on the top surface of the crankcase 26, i.e., on the top surface of the upper crankcase half 26*a*.

As shown in FIG. 6, each valve controlling apparatus 81 is configured by including: a spool valve 84 attached to the top surface of the crankcase 26; and an electromagnetic opening/closing valve 85 as driving means attached to the spool valve 84. The electromagnetic opening/closing valve 85 integrally includes a coupler part 103 protruding sideward.

The spool valve 84 includes: a valve housing 86 having an inlet port 88 and an outlet port 89, the valve housing 86 fastened to the top surface of the crankcase 26; and a spool valve body 87 slidably fitted in the valve housing 86.

A closed-end slide hole 90 is drilled in the valve housing 86. An end of the slide hole 90 is closed, and the opposite end thereof is opened. A cap 91 for closing an opening portion at the opposite end of the slide hole 90 is fitted in the valve housing 86. In addition, the spool valve body 87 is slidably fitted in the slide hole 90. A spring chamber 92 is formed between the spool valve body 87 and the closed end of the former end of the slide hole 90. A pilot chamber 93 is formed between the opposite end of the spool valve body 87 and the cap 91. The spring chamber 92 houses a spring 94 for biasing the spool valve body 87 in a direction in which the volume of the pilot chamber 93 is decreased.

The inlet port 88 and the outlet port 89 are provided in the valve housing 86 in a way that the inlet port 88 and the outlet port 89 are opened to the inner surface of the slide hole 90 in their respective locations arranged sequentially in a direction from one end to the other end along the axis of the slide hole 90 at an interval being interposed between the two locations. A circular concave part 95 for allowing the inlet port 88 and the outlet port 89 to communicate with each other is provided in the spool valve body 87. Consequently, as shown in FIG. 6, while the spool valve body 87 is moving to a location where the volume of the pilot chamber 93 become the smallest, the spool valve 87 causes the inlet port 88 and the outlet port 89 not to communicate with each other.

An oil filter 96 is attached to the inlet port 88. An orifice hole 97 for causing the inlet port 88 and the outlet port 89 to communicate with each other is drilled in the valve housing 86. Consequently, even when, as shown in FIG. 6, the spool valve body 87 is situated in a location where the spool valve body 87 causes the inlet port 88 and the outlet port 89 not to communicate with each other, the inlet port 88 and the outlet port 89 communicate with each other through the orifice hole 97. The hydraulic oil once supplied to the inlet port 88 subsequently flows to the outlet port 89 in an amount reduced by the orifice hole 97.

A release port 98 is drilled in the valve housing 86. The release port 98 communicates with the outlet port 89 through the circular concave part 95 only when the spool valve body 87 is situated in the location where the spool valve body 87 causes the inlet port 88 and the outlet port 89 not to communicate with each other. This release port 98 is open to the inside of the crankcase 26.

The valve housing 86 includes a passage 99 which always communicates with the inlet port 88. Through the electromagnetic opening/closing valve 85, this passage 99 is connected to a connection hole 100 which communicates with the pilot chamber 93, and which is drilled in the valve housing 86. For this reason, when the electromagnetic opening/closing valve 85 opens, the hydraulic pressure is supplied to the pilot chamber 93. The hydraulic force of the hydraulic pressure introduced to the inside of this pilot chamber 93 drives the spool valve body 87 in a direction which the volume of the pilot chamber 93 is increased. This drive causes the inlet port 88 and the outlet port 89 to communicate with each other through the circular concave part 95 in the spool valve body 87, and concurrently causes the outlet port 89 and the release port 98 not to communicate with each other.

As shown in FIG. 2, the crankcase 26 houses an oil pump 106 which operates in linkage with the crankshaft 30. Oil suctioned to the oil pump 106 through a strainer 107 is supplied to the inlet port 88 of the valve controlling apparatus 81 through an oil passage 101 provided in the crankcase 26. In addition, the outlet ports 89 of the valve controlling apparatuses 81 communicate with a passage 102 (see FIGS. 2 and 5) provided in the crankcase 26, the cylinder block 27 and the cylinder head 28 through the circular concave parts 77 of the intake-valve-operation-mode changing mechanisms 57 and the exhaust-valve-operation-mode changing mechanisms 58.

Consequently, once the electromagnetic opening/closing valves 85 of the valve controlling apparatuses 81 open, the inlet ports 88 and the outlet ports 89 communicate with each other. Thereby, the highly-pressurized hydraulic pressure acts on the hydraulic chambers 62 of the intake-valve-operation-mode changing mechanisms 57 and the exhaust-valve-operation-mode changing mechanisms 58, respectively. Thus, the intake-valve-operation-mode changing mechanisms 57 operate to close and stop the respective intake valves 46, whereas the exhaust-valve-operation-mode changing mechanisms 58 operate to close and stop the respective exhaust valves 47. On the other hand, when the electromagnetic opening/closing valves 85 of the valve controlling apparatuses 81 are closed, the inlet ports 88 and the outlet ports 89 cease to communicate with each other. Concurrently, the outlet ports 89 communicate with the release ports 98. Thereby, the hydraulic pressure in the hydraulic chambers 62 is released from the hydraulic chambers 62. Consequently, the slide pins 63 of the intake-valve-operation-mode changing mechanisms 57 move in the locations where the slide pins 63 open and close the intake valves 46, respectively. In addition, the slide pins 63 of the exhaust-valve-operation-mode changing mechanisms 58 move to the locations where the slide pins 63 open and close the exhaust valves 47.

The valve controlling apparatuses 81, 81 are attached to the top surface of the crankcase 26 in a way that: the longitudinal direction of the electromagnetic opening/closing valves 85 included in the valve controlling apparatuses 81 is along the top surface of the crankcase 26; the longitudinal direction thereof is along the width direction of the vehicle frame F; and the electromagnetic opening/closing valves 85 are arranged on the outer sides of the vehicle frame F in the width direction. As shown in FIG. 3, the valve controlling apparatuses 81 are arranged in the two sides symmetrical with respect to the vehicle center line CB which passes the center of the vehicle frame F in the width direction, and which extends in the front-rear direction of the vehicle frame F.

Furthermore, when viewed from the side, as shown in FIG. 2, the valve controlling apparatus 81 are arranged in a space surrounded by the main frames 14 of the vehicle frame F, the cylinder block 27 and the top surface of the crankcase 26, but under the air intake system 42.

Note that a starter motor 105 capable of imparting a rotational power for start to the crankshaft 30 is placed frontward of and under the cylinder block 27 constituting a part of the engine main body 25. The starter motor 105 is attached to the engine main body 25 in a way that the cylinder block 27 is interposed among the starter motor 105 and the valve controlling apparatuses 81.

Next, descriptions will be provided for effects of the first example. The valve controlling apparatuses 81, 81 for controlling the operations of the intake-valve-operation-mode changing mechanisms 57 and the exhaust-valve-operation-mode changing mechanisms 58 annexed to the parts corresponding to the cylinders located in the two ends of the valve system 50 in the cylinder arrangement direction are attached to the top surface of the crankcase 26. This means that the valve controlling apparatuses 81, 81 are arranged on the top surface of the crankcase 26, above which a surplus space is newly formed by housing the transmission M in the crankcase 26. For this reason, the first example makes it possible to arrange the valve controlling apparatuses 81 by effectively using the space above the crankcase 26. Thereby, the first example allows the engine EA compact in the direction along the axes C of the respective cylinders, and is capable of increasing the freedom of arranging parts designed to be placed in an upper end portion of the engine main body 25.

In addition, when viewed from the side, the valve controlling apparatuses 81 are arranged in the space surrounded by the cylinder block 27, the top surface of the crankcase 26 and the vehicle frame F. For this reason, the first example makes it easy for the valve controlling apparatuses 81 to be accessed from the side of the motorcycle, and is accordingly capable of increasing workability for detaching and attaching the valve controlling apparatuses 81 and other working. In addition, the first example is capable of causing the cylinder block 27, the crankcase 26 and the vehicle frame F to effectively prevent a flying stone or the like from hitting the valve controlling apparatuses 81.

Furthermore, the valve controlling apparatuses 81 are arranged under the air intake system 42 connected to the cylinder head 28. For this reason, the first example makes it possible to arrange the valve controlling apparatuses 81 with a better space efficiency by using the space formed between the air intake system 42 and the top surface of the crankcase 26.

Moreover, the starter motor 105 capable of imparting a rotational power for start to the crankshaft 30 is placed frontward of and under the cylinder block 27 in the engine main body 25 in a way that the cylinder block 27 is interposed among the starter motor 105 and the valve controlling apparatuses 81. For this reason, the first example is capable of securing a wider space above the crankcase 26, and thereby of increasing the freedom of arranging the valve controlling apparatuses 81.

Additionally, the valve controlling apparatuses 81 are arranged in a way that the longitudinal direction of the electromagnetic opening/closing valves 85 included in the valve controlling apparatuses 81 is along the top surface of the crankcase 26. For this reason, the first example makes it possible to check each electromagnetic opening/closing valve 85 from protruding from the top surface of the crankcase 26, and thus makes it possible to arrange parts and the like which are placed above the valve controlling apparatuses 81 in such a way as to be closer to the top surface of the crankcase 26. Accordingly, the first example allows the power unit PA and the motorcycle compact in the vertical direction.

In addition, the valve controlling apparatuses 81 are attached to the top surface of the crankcase 26 in a way that the electromagnetic opening/closing valves 85 are arranged on the outer sides of the vehicle frame F in the width direction. For this reason, the first example makes it easy for the electromagnetic opening/closing valves 85 to be accessed, and accordingly to attach and detach the electromagnetic opening/closing valves 85.

Figure 7:
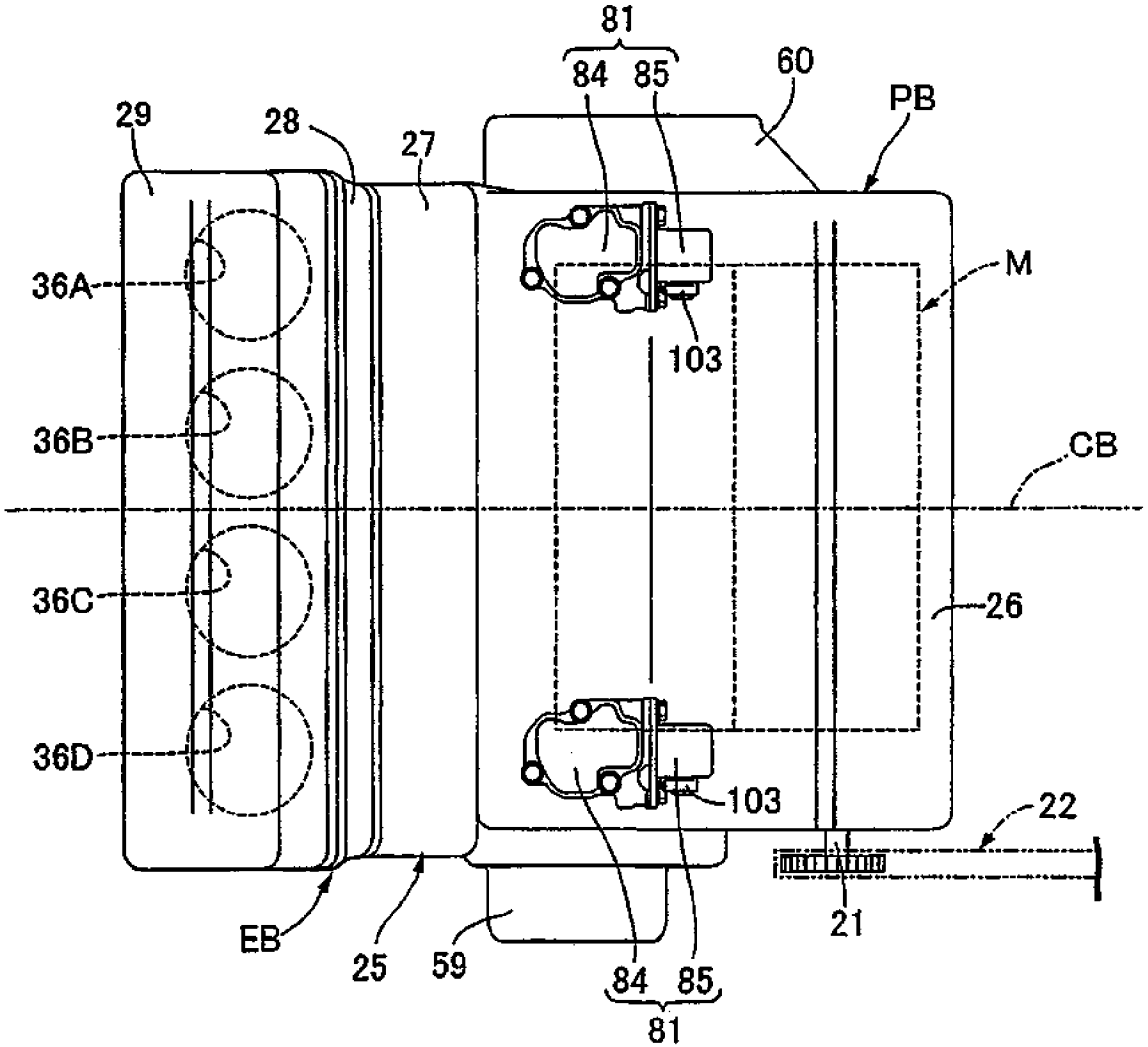
FIG. 7 is a plan view of a power unit according to a second embodiment, which corresponds to FIG. 3.

FIG. 7 shows a second example of the present invention. Components corresponding to those according to the first example will be only illustrated while the components are denoted by the same reference symbols, and detailed descriptions for the components will be omitted.

Valve controlling apparatuses 81, 81 included in an engine EB of a power unit PB are arranged on the two sides of the vehicle frame which are symmetrical with respect to the vehicle center line CB. The valve controlling apparatuses 81, 81 are attached to the top surface of the crankcase 26 included in the engine main body 25 of the engine EB. The longitudinal direction of the electromagnetic opening/closing valves 85 included in the respective valve controlling apparatuses 81 is set along the top surface of the crankcase 26, and in parallel with the front-rear direction of the vehicle frame.

The second example brings about the same effects as the first example does.

Figure 8:
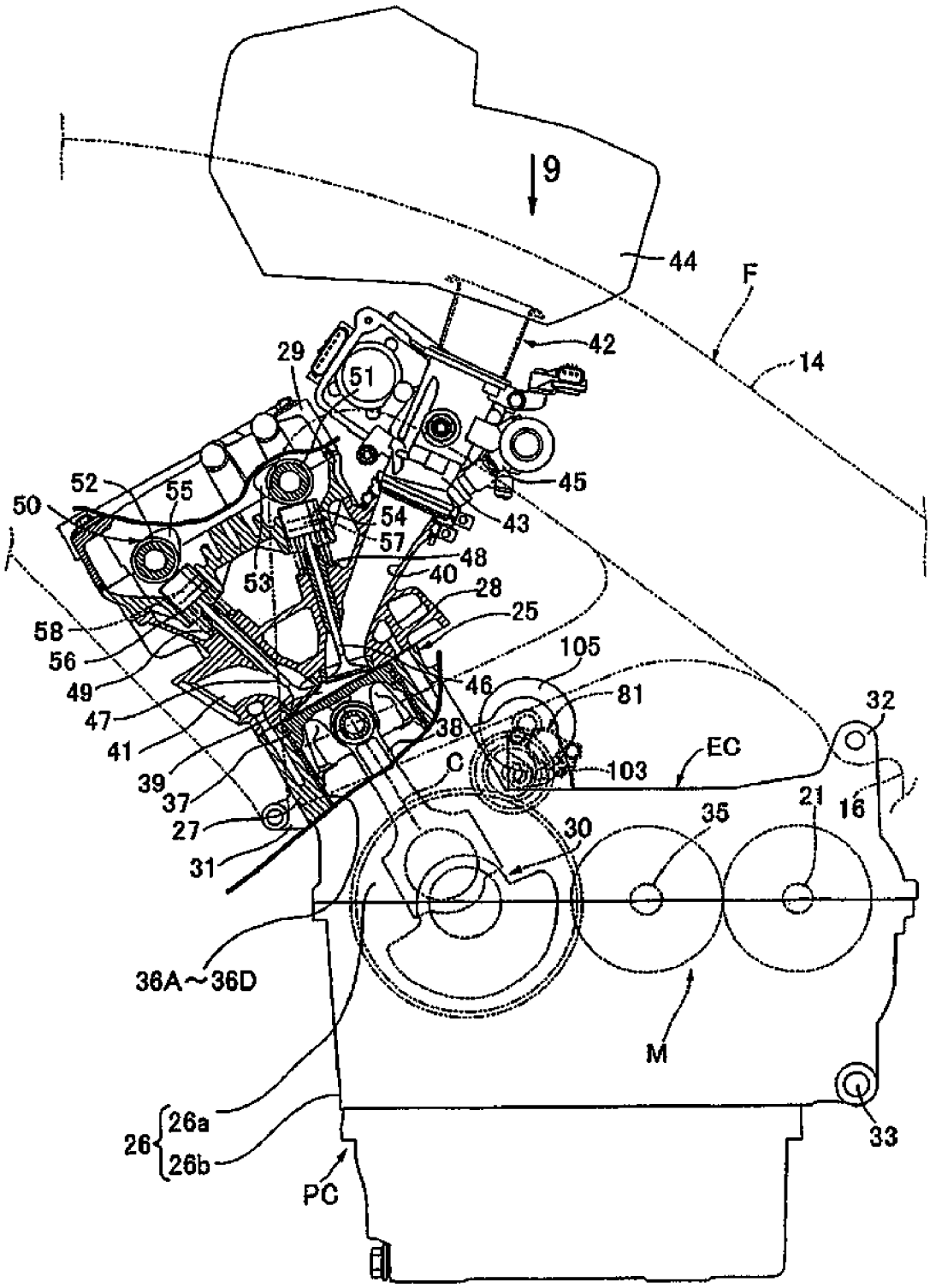
FIG. 8 is a partially cut-away side view of a power unit according to a third embodiment, which is viewed from the left.
Figure 9:
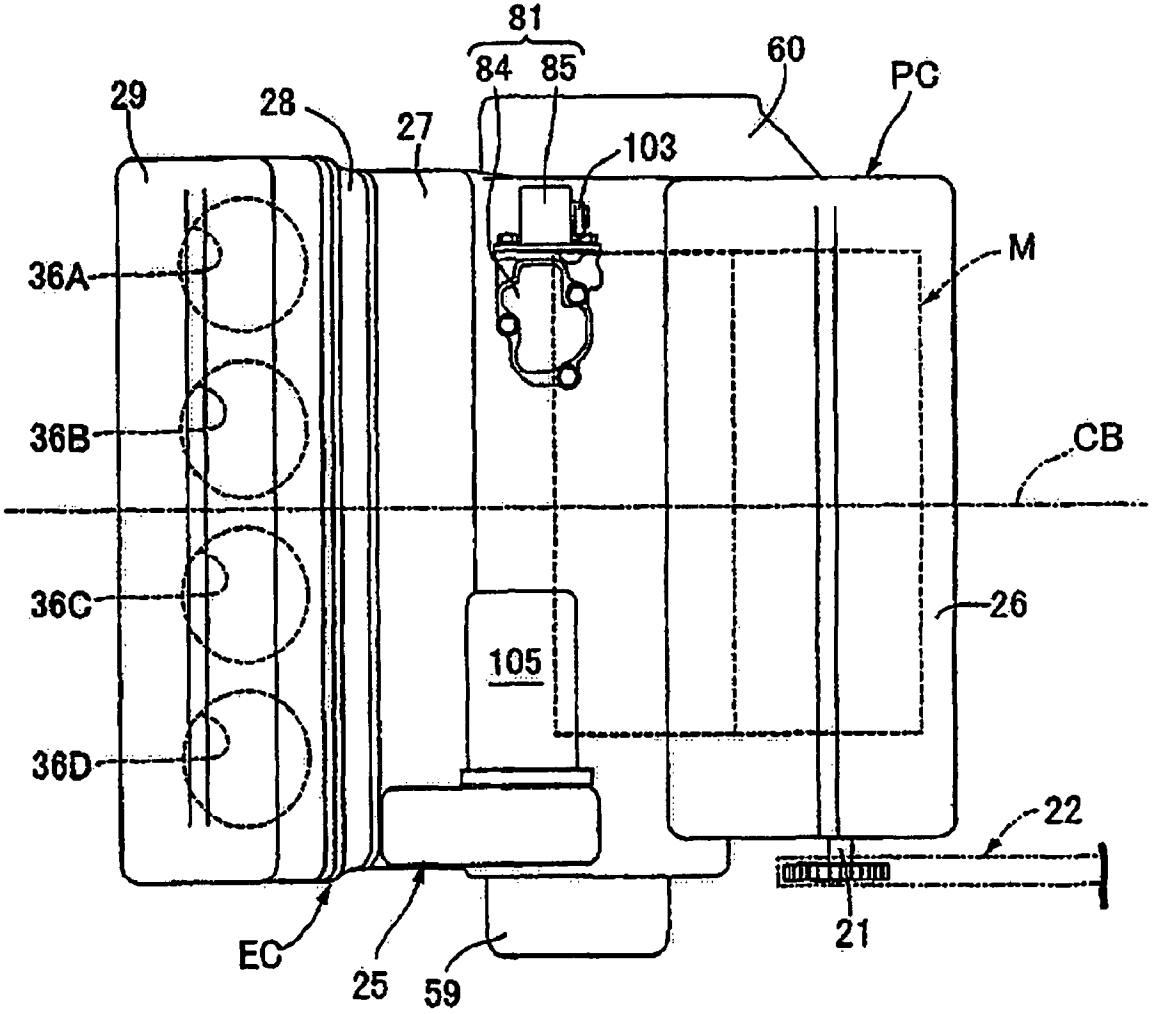
FIG. 9 is a plan view of the power unit of the third embodiment which is viewed in a direction indicated by an arrow 9 of FIG. 8.

FIG. 8 is a partially cut-away side view of a power unit according to a third example of the present invention, which is viewed from the left. FIG. 9 is a plan view of the power unit which is viewed in a direction indicated by an arrow 9 of FIG. 8. Components corresponding to those according to the first and second examples will be only illustrated while the components are denoted by the same reference symbols, and detailed descriptions for the components will be omitted.

An engine EC of a power unit PC includes a valve controlling apparatus 81 for commonly controlling the operations of the intake-valve-operation-mode changing mechanisms 57 (see the first example) and the exhaust-valve-operation-mode changing mechanisms 58 (see the first example) annexed to the parts corresponding to the cylinders which are located in the two ends of the engine main body 25 having four in-line cylinders in the cylinder arrangement direction. This valve controlling apparatus 81 is attached to the top surface of the crankcase 26 in a way that: the longitudinal direction of an electromagnetic opening/closing valve 85 included in the valve controlling apparatus 81 is set along the top surface of the crankcase 26 and in parallel with the width direction of the vehicle frame F; and the electromagnetic opening/closing valve 85 is arranged on the outer side of the vehicle frame F in the width direction.

In addition, the starter motor 105 capable of imparting a rotational power for start to the crankshaft 30 is attached above a front portion of the crankcase 26 and rearward of the cylinder block 27 in a way that the start motor 105 has its rotary shaft whose axis is in parallel with that of the crankshaft 30. When viewed from the side, the valve controlling apparatus 81 is arranged in a location where at least a part of the valve controlling apparatus 81 overlaps the starter motor 105.

The third example makes it possible to arrange the valve controlling apparatus 81 by effectively using a dead space formed in a vicinity of the starter motor 105.

The foregoing descriptions have been provided for the examples of the present invention. However, the present invention is not limited to the examples. Various design modifications can be made without departing from the present invention as recited in the scope of claims.

For example, the present invention is applicable to a power unit in which a valve controlling apparatus is designed to control operations of a valve system configured to change the opening and closing characteristics of intake valves or exhaust valves which always carry out their opening and closing operations instead of stopping the cylinders.

Although a specific form of embodiment of the instant invention has been described above and illustrated in the accompanying drawings in order to be more clearly understood, the above description is made by way of example and not as a limitation to the scope of the instant invention. It is contemplated that various modifications apparent to one of ordinary skill in the art could be made without departing from the scope of the invention which is to be determined by the following claims.

We claim:

1. A power unit for a vehicle, comprising:

an engine main body of an engine including:

a valve system capable of changing operational modes of an engine valve between a valve opening and closing mode and a valve closing and stopping mode;

a valve controlling apparatus which controls operations of said valve system;

a crankcase of said engine main body which houses a transmission; and a starter motor capable of imparting a rotational power to a crankshaft which is rotatably supported by said crankcase, wherein said engine main body is mounted on a vehicle frame, wherein said valve controlling apparatus is attached to a top surface of said crankcase, wherein, when viewed from a side, said valve controlling apparatus is arranged in a space surrounded by said top surface of said crankcase, said vehicle frame and a cylinder block, said cylinder block constituting a part of said engine main body and being connected to an upper portion of said crankcase, and wherein said starter motor is attached to said engine main body such that said cylinder block is interposed between said starter motor and said valve controlling apparatus.

2. The power unit for a vehicle according to claim 1, wherein said valve controlling apparatus is arranged under an air intake system connected to a cylinder head, said cylinder head constituting a part of said engine main body.

3. The power unit for a vehicle according to claim 2, wherein said valve controlling apparatus includes a driving means, and wherein said valve controlling apparatus is attached to said top surface of the crankcase such that a longitudinal direction of said driving means is along said top surface of said crankcase.

4. The power unit for a vehicle according to claim 2, wherein said valve controlling apparatus includes a driving means, and wherein said valve controlling apparatus is attached to said top surface of said crankcase such that said driving means faces outside of said vehicle frame in a width direction of the vehicle.

5. The power unit for a vehicle according to claim 1, wherein said valve controlling apparatus is arranged in a location where, when viewed from the side, at least a part of said valve controlling apparatus overlaps with said starter motor.

6. The power unit for a vehicle according to claim 1, wherein said valve controlling apparatus includes a driving means, and wherein said valve controlling apparatus is attached to said top surface of the crankcase such that a longitudinal direction of said driving means is along said top surface of said crankcase.

7. The power unit for a vehicle according to claim 1, wherein said valve controlling apparatus includes a driving means, and wherein said valve controlling apparatus is attached to said top surface of said crankcase such that said driving means faces outside of the vehicle frame in a width direction of the vehicle.

* * * * *